United States Patent [19]

Young, Jr.

[11] Patent Number: 4,829,918

[45] Date of Patent: May 16, 1989

[54] REPLENISHING APPARATUS FOR WEB PROCESSING MACHINES WITH EDGE DECURLER

[75] Inventor: William O. Young, Jr., Spartanburg, S.C.

[73] Assignee: Young Engineering, Inc., Spartanburg, S.C.

[21] Appl. No.: 107,176

[22] Filed: Oct. 13, 1987

[51] Int. Cl.[4] ..... D06C 25/00; D05B 7/00; B65H 19/18

[52] U.S. Cl. ..... 112/121.14; 112/262.3; 242/58.4; 38/144; 26/98

[58] Field of Search ..... 112/262.3, 121.14, 8, 112/262.1; 242/58.1, 58.4; 38/143, 144; 26/98, DIG. 1

[56] References Cited

U.S. PATENT DOCUMENTS

| | | | |
|---|---|---|---|
| 4,053,967 | 10/1977 | Mair | 26/98 |
| 4,217,682 | 8/1980 | Young, Jr. et al. | 26/98 |
| 4,322,026 | 3/1982 | Young, Jr. | 26/98 |
| 4,374,576 | 2/1983 | Ryan | 242/58.4 |
| 4,447,937 | 5/1984 | Young, Jr. | 26/98 |
| 4,578,845 | 4/1986 | Young, Jr. | 26/98 |
| 4,700,642 | 10/1987 | Hankinson, Jr. | 112/121.14 |

*Primary Examiner*—Andrew M. Falik

*Attorney, Agent, or Firm*—Dority & Manning

[57] ABSTRACT

A web replenishing apparatus and method for replacing an exhausted web supply with a fresh web supply. The apparatus includes means for detecting the exhaustion of the web supply and for stopping the web processing machine when the tail end of the web reaches a predetermined location. After the web processing machine is stopped, the empty spool or beam is removed by an operator and a fresh supply beam is placed thereon. The head end of the replacement fabric is draped over a lift roll and a supporting surface into a predetermined position. A clamp is provided for locating and securing the edges of the tail end of the exhausted web and the edges of the head end of the replacement web and for bringing them into alignment with each other at a sewing station. The excess web is pretrimmed from the head and tail ends and the head and tail ends of said webs are sewn together by a horizontal sewing machine. Thereafter, the edges of the webs are released automatically and the web processing machine is restarted, processing the replacement fabric.

20 Claims, 7 Drawing Sheets

REPLENISHING APPARATUS FOR WEB PROCESSING MACHINES WITH EDGE DECURLER

BACKGROUND OF THE INVENTION

The present invention relates to a new and improved apparatus for replenishing or replacing supply rolls of web on a web processing machine. The apparatus of the invention replaces exhausted rolls of web with a new roll of web substantially automatically.

In the past in web processing machines such as tenter frames, open width dyeing of fabrics or webs, singers, dryers, or the like, whenever the supply of web to the processing machine ran out or became exhausted it was necessary for the operator to stop the machine, grasp the tail end of the exhausted web and to being it together manually with the head end of a new supply roll and to sew the two ends together, after trimming the excess fabric from the seam area and then to restart the processing machine.

It has been necessary for the operator to be very skillful in matching up the edges of the fabric or webs which could be over sixty inches in width. This required substantial skill in the operator and a great amount of machine downtime while the operator carefully matched the edges of tee fabric and carefully sewed the two pieces of fabric together before resuming the operation of the fabric processing machine. The excessive downtime often resulted in over-processing of the fabric while it is stopped awaiting the replenishment causing a waste of the overprocessed material.

SUMMARY OF THE INVENTION

It is a primary object of the present invention to provide an apparatus for replenishing or replacing an exhausted web supply on a web processing machine with a fresh supply automatically.

A further object of the present invention relates to an edge decurler for locating and decurling he edge of a web and for firmly gripping the edges of a web.

It is a further object of the present invention to provide an automatic apparatus for joining the head end of a fresh web supply to the tail end of an exhausted supply of web for a web processing machine.

It is yet another object of the invention to provide a mechanism for locating the edges of a stationary fabric, removing any pleats, curls, folds or the like from the fabric, and securely gripping or holding the edges of the web.

Generally speaking, in order to implement these and still further objects of the invention, which will become more readily apparent as the description of the invention proceeds, and to eliminate the problems and limitations of the prior art, the present invention provides an apparatus for replacing an exhausted roll of web with a fresh supply of web. The apparatus locates and positions the head end of the replacement web supply and the tail end of the exhausted web supply, holds said head end and tail end and aligns the head end and tail end at a sewing station where they are united automatically by a sewing machine which traverses the width of the webs.

The invention includes a combined edge detector, decurler, positioner and holder for detecting, decurling and positioning and securely holding the edge of the stationary web. The detector has a pair of opposed jaws which extend along each side of the web adjacent the edge and sensor means for sensing the position of the edge of the web, and for activating a mechanism to move the jaws relative to the web to position the edge of the web in a predetermined location. The edge detector also has a plurality of exhaust ports for directing air currents against the surface of the web when it is in the position between the jaws where it covers the sensor. After the edge of the web is positioned in its predetermined position between the jaws, a plurality of pins are moved from openings in one of the jaws through the web and into openings on the other of the jaws to securely hold the web in position between the jaws.

BRIEF DESCRIPTION OF THE DRAWINGS

The invention will be better understood, and objects other than those set forth above, will become apparent when consideration is given to the following detailed description thereof. Such description makes reference to the annexed drawings wherein.

DETAILED DESCRIPTION OF THE DRAWINGS

Figure 1:
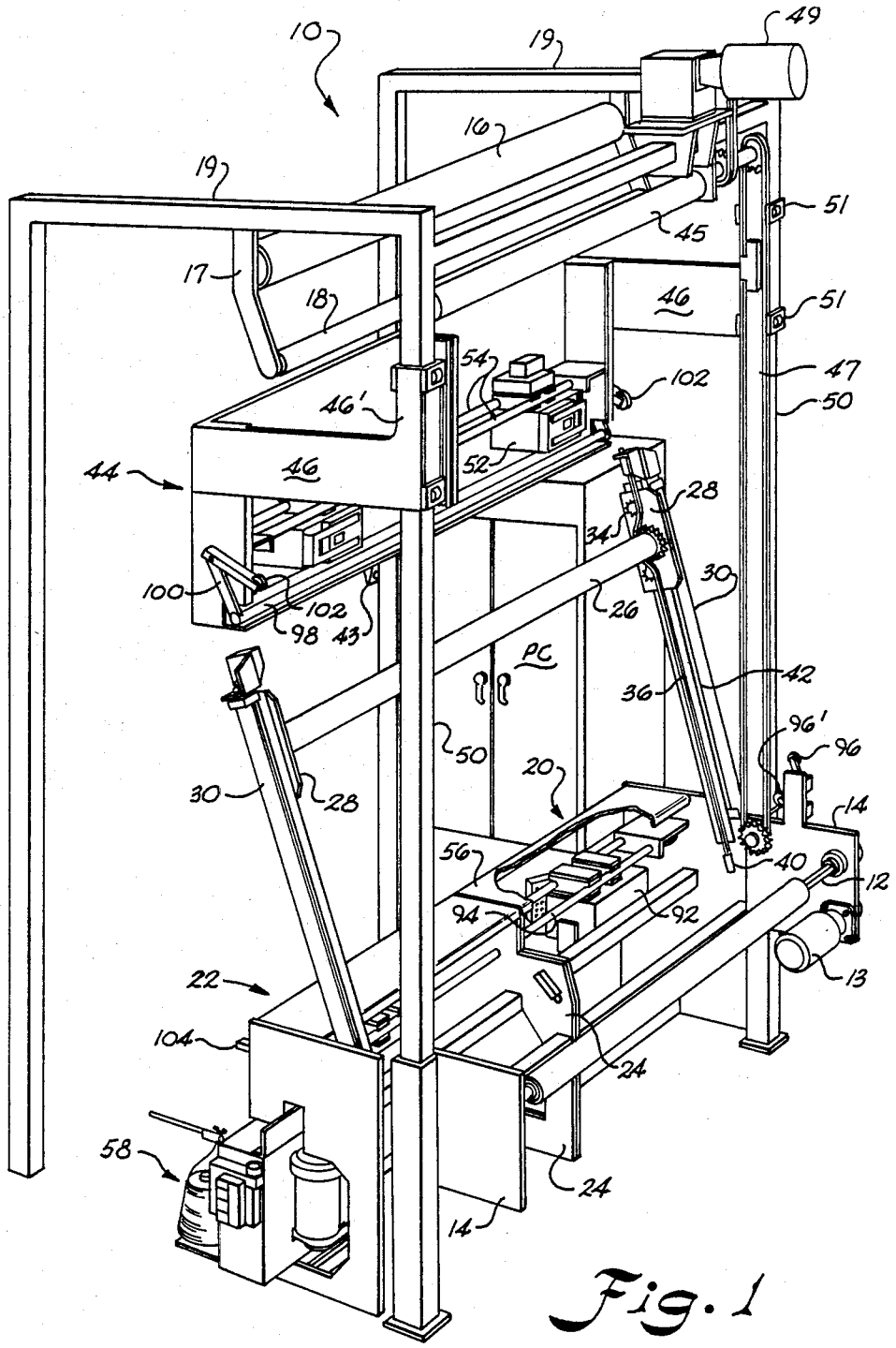
FIG. 1 is a perspective view of the web replenishing apparatus, constructed according to the teachings of the present invention.

Referring now to FIG. 1 of the drawings, wherein a web replenishing apparatus 10 is illustrated. Web replenishing apparatus 10 comprises a web roll support 12 which is supported for rotation on end frame members 14. A drive motor 13 is also mounted on the end frame member 14 for driving roll support 12 in either direction by means of drive elements, not illustrated herein. However, it will be understood that such drive elements may comprise gears, chains and sprockets, or the like.

Near the top of the framework of the apparatus 10 is a web guide roll 16 and a web holddown roll 18 which are supported on arms 17, depending from horizontal frame members 19. Rolls 16 and 18 are normally idler rolls but may be driven if desired.

The lower frame of the web replenishing apparatus 10 is divided into a right module 20 and a left module 22, each of which have center plates 24 which are bolted together to provide a unitary apparatus. Should it become necessary or desirable to produce a wider machine, it is only necessary that a spacer module be inserted between center plates 24 and that appropriate longer web roll supports 12 and the like be added to the apparatus. For purposes of this invention, it will be understood that each module has apparatus for detecting and holding the edges of the web independently of each other but simultaneously therewith, as controlled by a programmed controller PC.

The web replenishing apparatus 10 also comprises a web lifting roll 26 which is mounted for rotation on a pair of web lift roll support slides 28. Support slides 28 are, in turn, supported on lift roll support arms 30 for traversing said support arms 30 from top to bottom. Disposed on at least one end of lift roll 26 is a sprocket 32 which engages a fixed chain 36 which is guided about sprocket 32 by means of idler sprockets 34. As slides 28 traverse arms 30 from one end to the other, lift roll 26 is rotated as its sprocket moves relative to chain 36 which, in turn, is anchored to the end of the lift roll support arm 30 at 38 and to the frame of the apparatus at 40. A portion of slide 28 extends into lift roll support arms 30 through a guide slot 42 which extends longitudinally of arms 30. Disposed within arms 30 is a cable cylinder (not seen) for causing slides 28 to move longitudinally of arms 30. As slide 28 moves from its uppermost position to its lowermost position, lift roller 26 revolves in a clockwise direction as seen in FIG. 1. As slide 28 moves from its lowermost position to its uppermost position lift roll 26 will revolve in a counterclockwise direction as seen in FIG. 1.

At the upper part of the apparatus 10, as seen in FIG. 1, is mounted a tail end decurler support carriage 44, which is generally z-shaped with generally horizontal support arms 46 terminating in vertical guide feet 46' which are guided on upright decurler carriage guide beams 50 by guide rolls 51 which are located in the vertical guide feet of support arms 46. Tail end decurler support carriage 44 is guided for vertical movement along the carriage guide beams 50 and the guide feet 46' of arms 46 are connected to the elevator chain 47 on each of the beams for moving the carriage 44 in a vertical path.

Motor 49 is supported at the top of the frame and is adapted to drive elevator chains 47 through a drive shaft 45 to which an appropriate sprocket is connected for rotation therewith. As drive shaft 45 is rotated in the counter-clockwise position, as seen in FIG. 1, the tail end decurler support carriage will move downward along guide beams 50. Whenever drive shaft 45 is driven in the clockwise direction as seen in FIG. 1, carriage 44 will return to its uppermost position.

Figure 8:
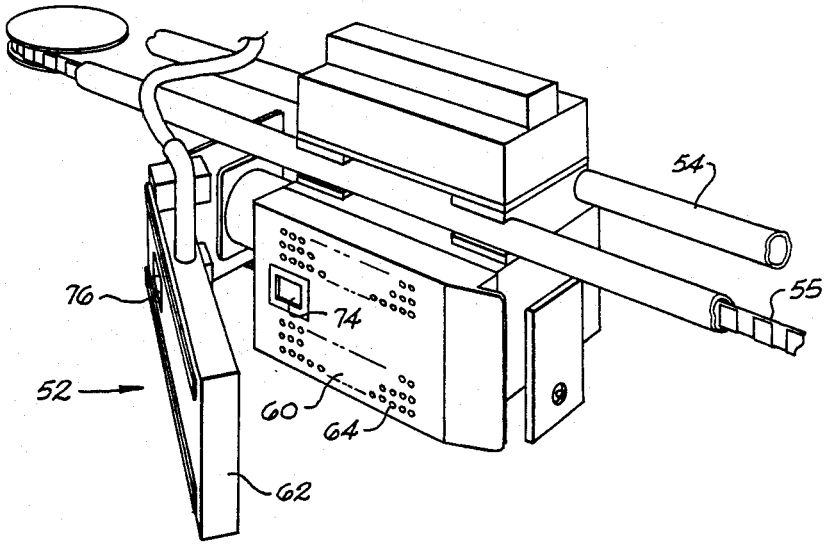
FIG. 8 is a perspective view of the edge detector, decurler, positioner, and holder of the invention.

Mounted on decurler support carriage 44 are a pair of tail end decurlers and holding devices 52, which are mounted on traverse rods 54 for traversing movement thereon. Traverse rods 54 are hollow and a drive belt 55 extends through the hollow traverse rods for traversing the decurler (as seen in FIG. 8). The operation of the decurlers 52 will be described in more detail hereinafter. At this point, it is sufficient to note that each decurler 52 is driven by its own drive belt 55 on each module of the apparatus.

The two modules 20 and 22, when bolted together, provide a web support surface 56 which will be utilized as described hereinafter in more detail. At the lower part of the apparatus and on the back side, as seen in FIG. 1, is a sewing and trimming station 58 at which the tail end of the exhausted fabric is sewn onto the head end of the replacement fabric roll for replenishing the fabric supplied to the web processing machine.

Figure 8B:
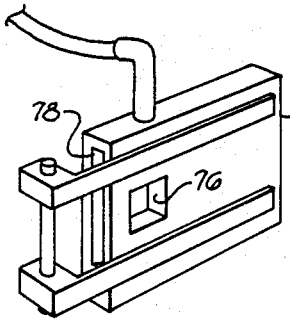
FIG. 8*b* is a perspective view of the pivoting jaw of the edge detector illustrated in FIG. 8.
Figure 8A:
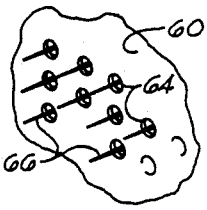
FIG. 8*a* is an enlarged view of a portion of one of the jaws of the edge detector illustrated in FIG. 8, showing schematically the pins for holding the web.
Figure 8C:
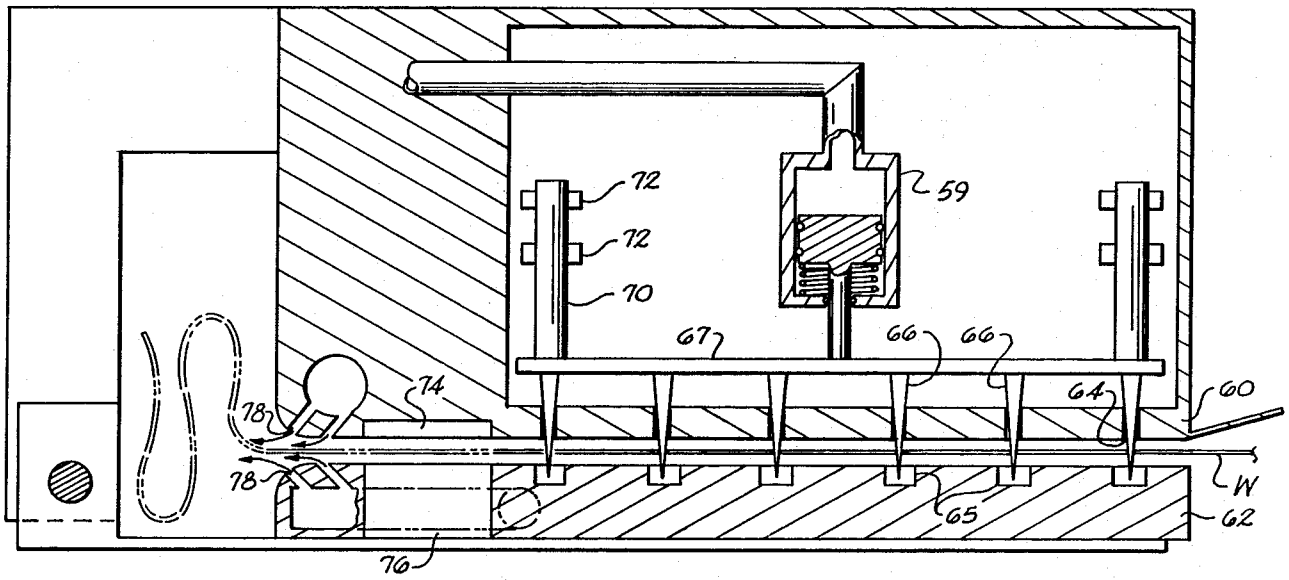
FIG. 8*c* is cross-sectional plan view of the edge detector, decurler, positioner and holder illustrated in FIG. 8 with the jaws closed on the web and the pins in the holding position.

Referring now to FIGS. 8, **8*a*, 8*b* and 8*c* wherein the web decurler and detecting apparatus is illustrated. Apparatus 52 is typical of the decurlers used for both the head end of the replacement fabric and for the tail end of the exhausted fabric and each operate as described herein. Decurling apparatus 52 comprises a fixed jaw 60 to which is hinged a pivoting jaw 62. Fixed jaw 60 is adapted to extend along one side of a web adjacent to its edge and pivoting jaw 62 is adapted to extend along the opposite side of the same web. The fabric facing surfaces of the fixed jaw 60 and the pivoting jaw 62 are each provided with a plurality of openings 64 and 65 which are aligned with each other. A plurality of pins 66 are supported on a plate 67 within the body of fixed jaw 60. Plate 67 is supported by a pair of guide rods 70 which are guided for reciprocating movement in guides 72. A pneumatic cylinder 68 is adapted to urge plate 67 away from the surface of fixed jaw 60 and to retract pins 66 into opening 64 and out of contact with web W which may be in the space between the fixed jaw and the pivoting jaw, as seen in FIG. 8*c***.

Each of the decurling devices are provided with a sensor 74 for sensing the position of the web between the pivoting jaw and the fixed jaw and air currents are expelled through ports 78 in..both of the jaws for impinging upon the web at an acute angle for removing any curls, pleats, folds or the like from the body of the fabric by propelling it outwardly as apparatus 52 moves outwardly by tensioning the fabric prior to the securing of the web between jaws 60 and 62 by pins 66. When sensor 74 looks through window 76 in the pivoting jaw 62 and does not see the fabric, a signal is sent to the programmed controller PC as seen in FIG. 1, which pressurizes pressure cylinder 68, as seen in FIG. **8*c* which then causes pins 66 to penetrate through web W and to enter the openings 65 of pivoting jaw 62, to firmly and securely hold web W in place between jaws 60 and 62**.

While the decurling device illustrated in FIGS. 8, **8*a*, 8*b* and 8*c* feature pins as the holding device for holding web W, it will be understood that instead of pins, pressure plates or the like may be utilized to hold or grip the edge of the fabric instead of the use of pins as illustrated. Referring again now to FIG. 1, beneath support surface 56 is a head end decurler carriage 92 which is mounted on traverse rods 94 for traversing the width of the web and carries on each end, that is each module, an edge decurler which is that shown in FIGS. 8, 8A and 8B** as described hereinabove.

Figure 14:
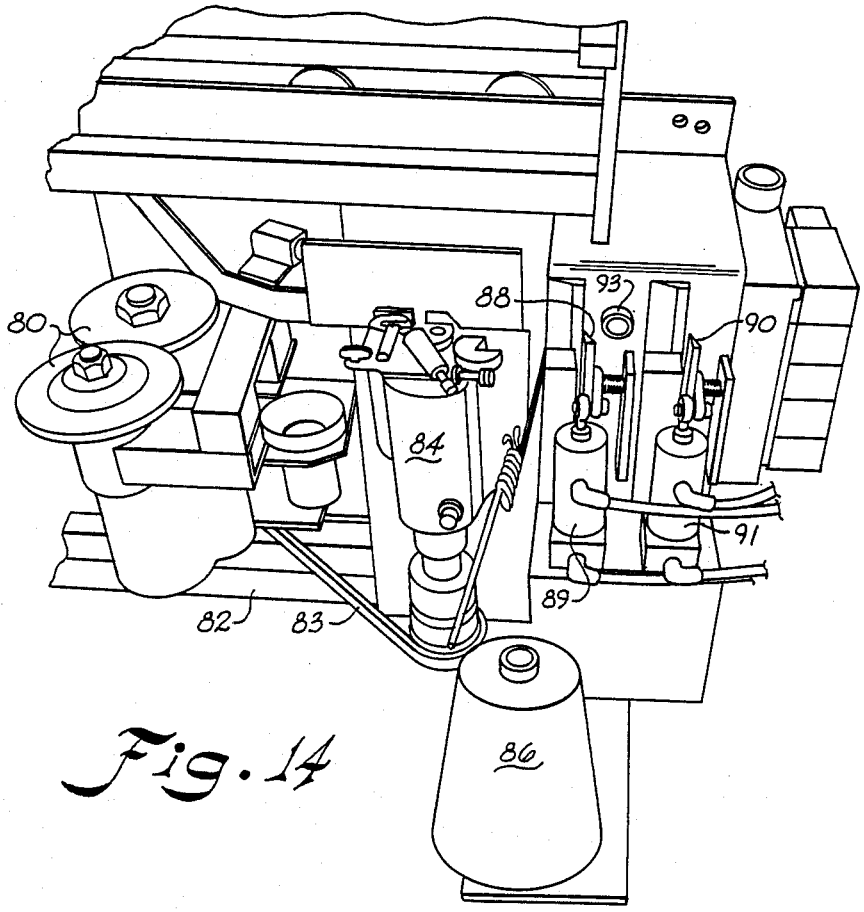
FIG. 14 is an enlarged perspective view of the sewing and pretrimming station of the invention.

Referring now to FIG. 14 of the drawings wherein sewing and trimming station 58 is illustrated in an enlarged perspective view. Sewing station 58 is mounted on a sewing and pretrimmer carriage 82 which traverses across the width of the web to pretrim the ends of the web to a uniform length and to sew the head end of the replacement to a tail end of the exhausted web. A trimmer precedes the needle of the sewing head as is conventional. Mounted on the leading end of sewing carriage 82 is a pair of rotary pretrimmers 80 which are driven by a motor mounted on the sewing carriage (not seen in FIG. 14) through belt 83. Belt 83 also drives sewing head 84 to sew the ends of the fabric together as carriage 82 traverses across the width of the webs. Sewing head 84 draws sewing thread from supply 86 which is also carried by the sewing head carriage 82.

Disposed adjacent the sewing head carriage 82 is a pair of chain stitch cutters 88 and 90, which are operated by pneumatic pistons 89 and 91 to sever the chain stitch made by the sewing head 84 at the edge of the web. The waste from the cutters 88 and 90 is drawn off by a waste collecting tube 93 through suction created therein by a source of negative pressure, not shown.

Located adjacent the sewing head 84 is a pair of head end decurlers 92, which are supported on traverse rods 94 which are identical to the decurling device illustrated in FIGS. 8, 8*a*, 8*b* and 8*c* and described in detail hereinabove.

Extending across the lower portion of decurler support carriage 44, as seen in FIG. 1, is an elongated tucking bar 98 which is mounted on tuck bar arms 100. Tuck bar 98 is spring located and rests against the lower portion of carriage 44. Tuck bar arms 100 are generally V-shaped and are pivotally supported on the carriage 44 and include a tuck bar arm follower 102 which is on one end of the V-shaped tuck bar arm 100. As carriage 44 traverses guide beams 50 support arm 46 contacts a limit switch 96 which interrupts the descent of carriage 44 momentarily while the edges of the webs are aligned. The tuck bar arm follower 102 then inpinges upon tuck bar cam 104 which is mounted on the end frame near the sewing station on each end of the apparatus and limit switch 96' stops the descent of carriage 44. When follower 102 strikes cam 104, arm 100 pivots about its pivot point and tuck bar 98 moves inwardly to place or tuck the tail end of the exhausted fabric against the head end of the replacement fabric web for the trimming and sewing operation as described above.

Figure 2:
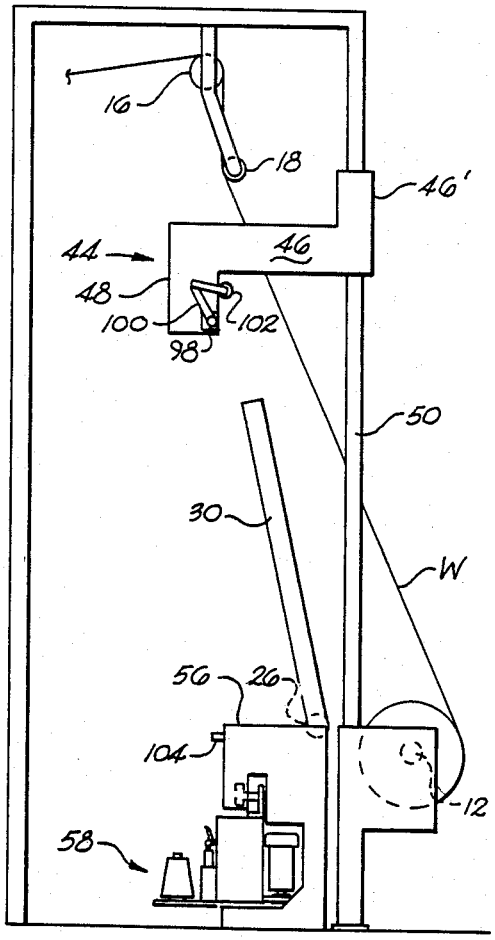
FIGS. 2, 3, 4, 5, 6 and 7 illustrate, schematically, the positions of the apparatus shown in FIG. 1 while performing the various operations of the invention.

Referring now to FIGS. 2, 3, 4, 5, 6 and 7 wherein the sequence of replacing an exhausted fabric is illustrated. In FIG. 2, a web 40 is drawn from its supply beam which is mounted on roll support 12 and traverses under holddown roll 18 and over guide roll 16. At this point in the operation, carriage 44 is in its uppermost position and fabric lift roll 26 is in its lowermost position, where each of them remains during the process of feeding web W to the web processing machine.

Figure 3:
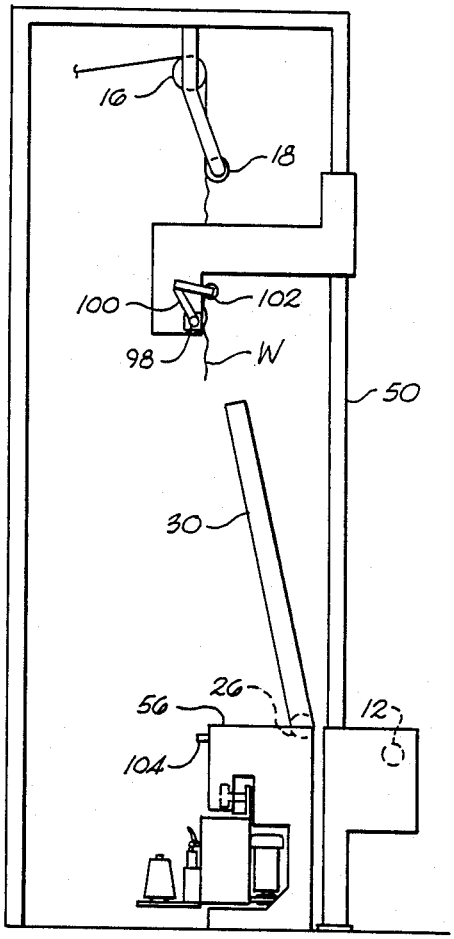

When the web supply is exhausted, as seen in FIG. 3, the tail end of web W is sensed by a sensor 43 which stops the web processing machine and stops the feeding of web as seen in FIG. 3. In this position, the tail end of web W hangs parallel to carriage 44. The decurler and edge detector 52 locate and secure the edges of web W at point above the tail end of web W, as seen in FIG. 3, and the supply beam for web W, which is now exhausted, is removed from support 12 by the operator.

Figure 4:
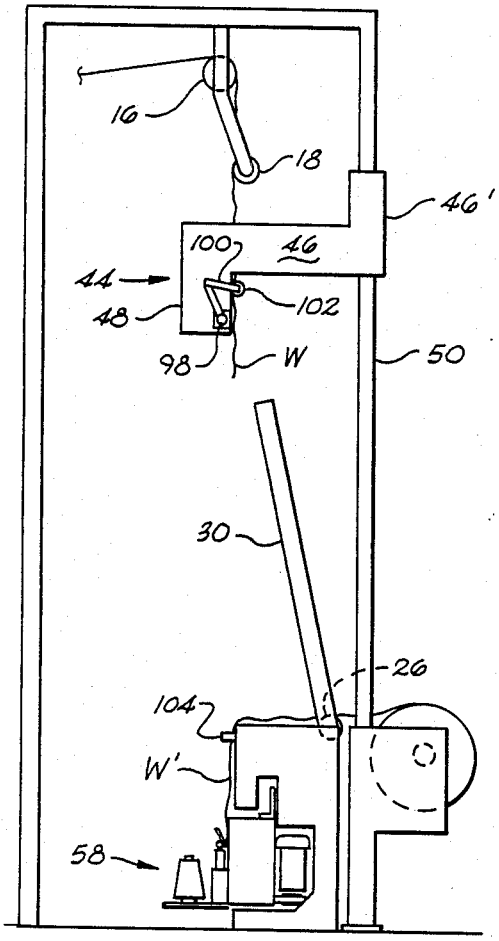

As seen in FIG. 4, a new supply of web W' is placed on support 12 by the operator and the head end of web W' is manually draped over lift roll 26 and web support surface 56 and its edges are located and secured by the decurling apparatus such as that shown in FIGS. 8, 8*a*, 8*b* and 8*c* as described in detail hereinabove. At this point, the operator manually jogs the feed motor 13 to adjust the position of the head end of web W' to a position which is below the horizontal plane in which the decurlers 92 extend.

Figure 5:
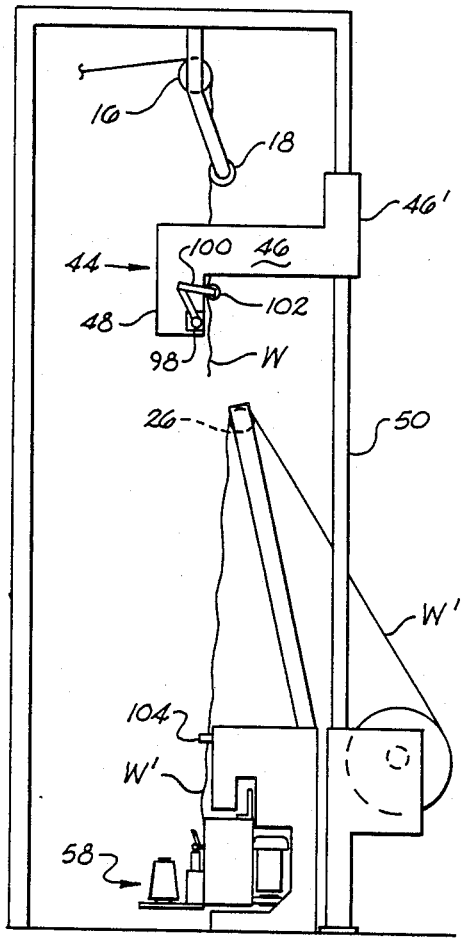

At this point, the operator pushes a button on the control panel to begin the automatic replenishment o the web by connecting the head end of web W' to the tail end of web W. The decurlers on the tail end decurling carriage 44 and the head end decurler 92, which are mounted on traverse rods in the support frame for the apparatus, seek and find the edges of the head end and the tail end of the webs, at the same time removing any curls, pleats, folds or the like from the webs. Once the edges of the head end and the tail ends of the webs are found and secured, decurler carriage 44 is lowered by elevator chains 47 and at the same time, the lift roll 26 is traversed along its support arms 30 to its uppermost position. As lift roll 26 moves from the lowermost position (as seen in FIG. 4) to its uppermost position (as seen in FIG. 5) roll 26 revolves counter-clockwise to draw web W' from the supply roll and to orient web W' for the piecing operation.

Figure 6:
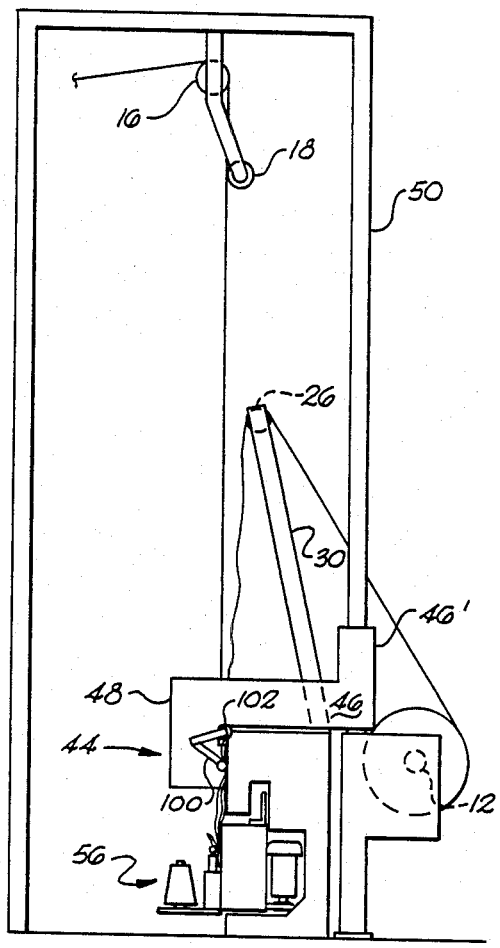

As seen in FIG. 6, carriage 44 is moved by the elevator chains 47 to its lowermost position and tuck bar 98 is moved into the tucking position to bring the tail end of web W into abutting contact with the head end of web W' in preparation for the sewing and trimming operation. When the webs are in the position shown in FIG. 6, the head end decurlers and the tail end decurlers are moved to bring the edges of the head en of web W' into registry or alignment with the edges of the tail end of web W in preparation for the sewing operation. When the alignment is completed, the tuck bar 98 is moved to tuck or hold the tail end of web W in contact with the head end of web W' in preparation for the sewing operation. After the edges of the webs are aligned, the sewing carriage 82 traverses the width of the webs and the pretrimmer disc 80 trims the excess web to provide a workable fabric configuration to sewing head 84.

Figure 7:
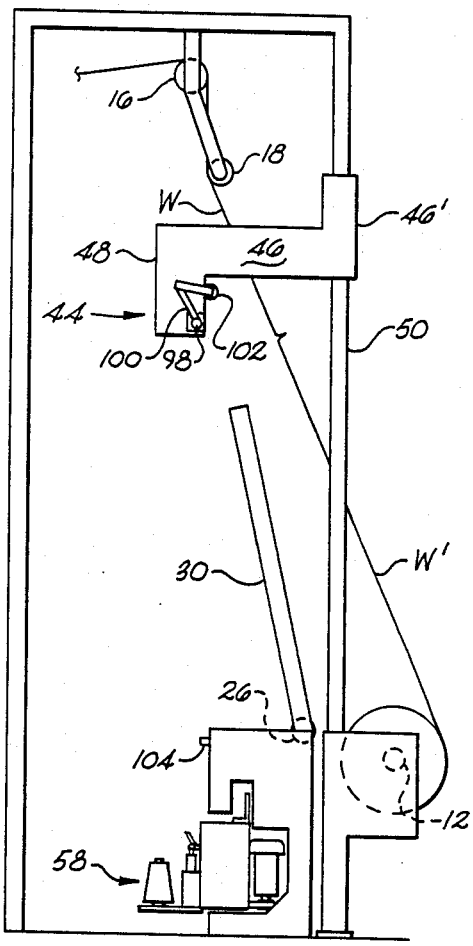

Sewing head 84 is also mounted on carriage 82 and operates with its needle reciprocating in the horizontal plane to sew the head end of web W' to the tail end of web W. At the same time, the remaining excess web is trimmed by another trimmer associated with the sewing head so as to produce a uniform seam between the tail end of web -W and the head end of web W'. After the sewing and trimming operation is completed, carriage 44 returns to its uppermost position as seen in FIG. 7, and lift roll 26 returns to its lowermost position and the web processing machine, being supplied the web, is restarted to draw the united webs over guide roll 16 enroute to the web processing machine, as seen in FIG. 7.

Figure 9:
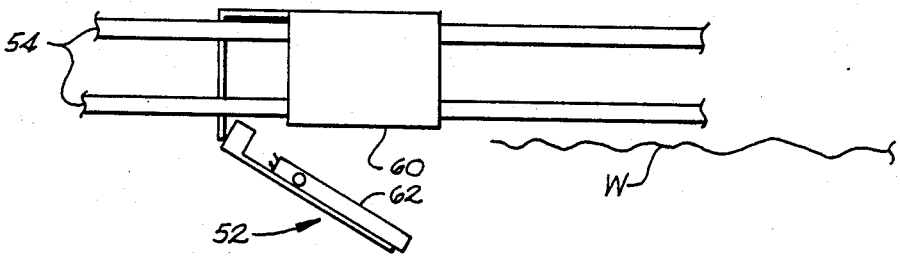
FIGS. 9, 10, 11, and 12 illustrate schematically, the steps of locating one edge of a web, decurling it, positioning the web in a predetermined location, and securing the web within the jaws of the web detector.

Referring now to FIGS. 9, 10, 11 and 12, the operation of the decurler apparatus 52 in finding and receiving the edge of the web will be explained. As seen in FIG. 9, the decurler 52 is supported on traverse rods 54 for traverse transversely of the web W. At this point, the pivoted jaw 62 is pivoted away from fixed jaw 60 so as t permit the edge of web W to enter into the space between the jaws 60 and 62, as seen in FIG. 9.

Figure 10:
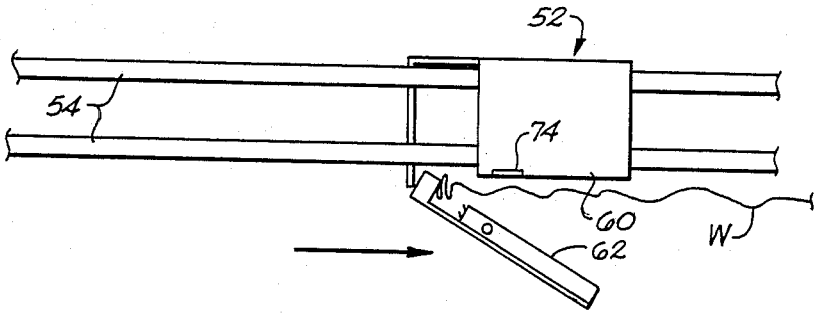
Figure 11:
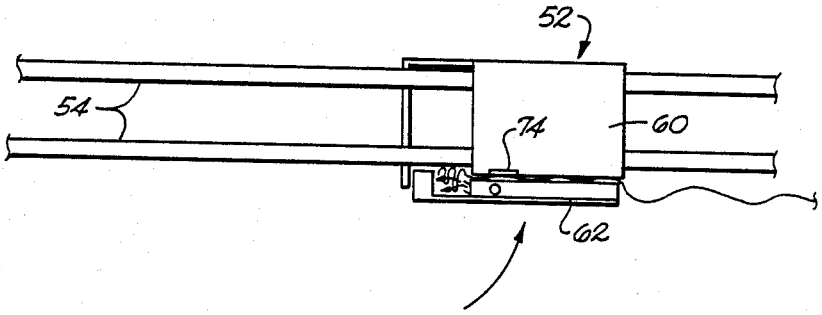
Figure 12:
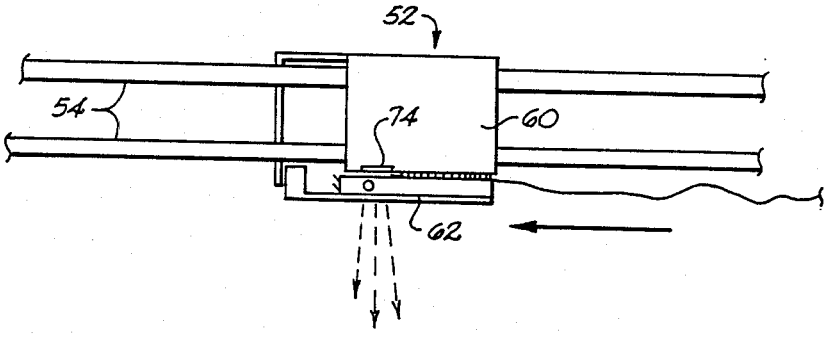

As seen in FIG. 10, when the edge of web W enters the open jaws of decurler 52 its presence is sensed by a sensor 74 which sends a signal to the programmed controller PC indicating that the web has been located. At this point, pivoted jaw 62 closes upon web W as seen in FIG. 11. At this point, compressed air is forced from air ports 78 which impinge upon the web between jaws 60 and 62. At the same time, decurler 52 is moved towards the edge of web W to tension the web and to remove all curls, pleats, folds and the like therefrom. After the web has been decurled, decurler 52 continues to move in the direction of the edge until sensor 74 is uncovered, and detects the absence of the web between the sensor 74 and its window 76. At this time, the web edge will occupy the position shown in FIG. 8*c*, as described above. When sensor 74 reports to the programmed controller the position of the edge of web W, the programmed controller PC then pressurizes the pressure cylinder 59 causing pins 66 to penetrate the web and to enter openings 65 on the pivoted jaw to securely pin and hold the edge of the web as seen in FIG. 8*c*. After the edge of the web is secured, the decurler 52 is moved slightly towards the edge of the web to provide tension on the web to flatten the web and to remove any pleats, curls, folds or the like which might remain in the web between the decurler 52 and a similar unit located on the opposite side of the web W.

Figure 13:
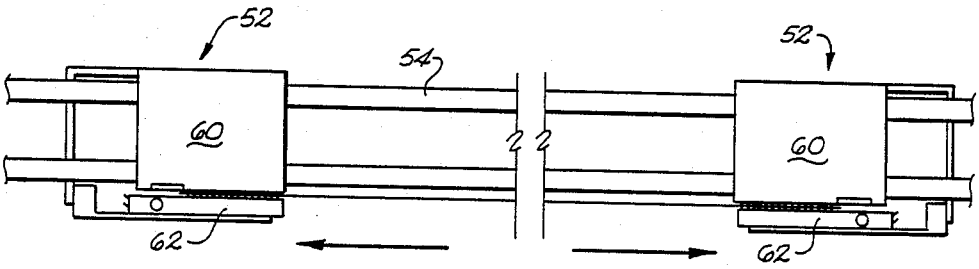
FIG. 13 is a schematic plan view of two edge detectors working in cooperation to detect and secure the opposed edges of a stationary fabric.

It will be appreciated that a decurler 5 is provided for each side of the web W and W′ for detecting and securing the edges of web W and W′. After the edges of the web are secured, decurlers 52 are moved in opposite directions as seen in FIG. 13, to apply a slight tension on the web between the decurlers to cause the web to be flattened for the web joining or sewing operation as described above. It will be understood that the decurlers 52 on each side of the web will find, decurl, and secure the edges of the web simultaneously for both the tail end of the exhausted web W and for the head end of the replacement web W′.

It will also be understood that the sequence of operation of the apparatus as described hereinabove is controlled by a program controller PC which is not describe in detail because its operation is deemed to be within the skill of those skilled in the control art and may take any configuration so long as the proper sequence of operations are performed by the mechanisms described hereinabove.

While there is shown and described a preferred embodiment of the invention, it is to be understood that the invention is not limited thereto but may be otherwise variously embodied and practiced within the scope of the following claims.

What is claimed is:

1. A web replenishing apparatus for replacing an exhausted web supply with a fresh web supply, comprising:

(a) means for supporting a supply roll of web for supplying web to a web processing machine;

(b) means to detect the exhaustion of said web supply and to stop said web processing machine with the tail end of said web in a predetermined location;

(c) means to detect the tail end of said exhausted web, locate each of the longitudinal edges of said tail end, remove any pleats, curls, folds, wrinkles or the like from said tail end by exerting lateral force on said edges and to firmly hold each of said edges;

(d) means to detect the head end of a replacement web, locate each of the longitudinal edges of said head end, remove any pleats, curls, folds, wrinkles or the like from said head end by exerting lateral force on said edges and to firmly hold each of said edges;

(e) means for bringing said head end and said tail end into edge alignment and into close proximity with each other at a predetermined location;

(f) means for sewing said aligned head and tail ends together;

(g) means for releasing said edges of said head and tail ends of said sewn webs;

(h) means for restarting said web processing machine; and (i) programmed control means for controlling the operation of said edge detection means, said edge alignment means, said pretrimming means, and said sewing means.

2. A web replenishing apparatus as set forth in claim 1, wherein said pleats, curls, folds, wrinkles or the like are removed from said web by means of compressed air impinging thereon through a series of air ports in each of said decurling means.

3. A web replenishing apparatus as set forth in claim 1, wherein said means for detecting the longitudinal edges of said tail end comprises a pair of opposed jaws.

4. A web replenishing apparatus as set forth in claim 3, wherein a plurality of pins penetrates the edge of the web between said jaws of the edge detector to securely hold the edge of the web.

5. A web replenishing apparatus as set forth in claim 1, wherein said decurling means is located on the opposed longitudinal edges of both the tail end of the exhausted web and the head end of the replacement web.

6. A web replenishing apparatus as set forth in claim 1, wherein the means for removing pleats, curls, folds, wrinkles or the like from the ends of said webs comprises a plurality of air currents which impinge upon the surface of said web at an acute angle directed towards the edge of said web.

7. A web replenishing apparatus as set forth in claim 1, wherein said sewing means comprises a needle which reciprocates in a horizontal plane.

8. A web replenishing apparatus as set forth in claim 1, wherein said pretrimming means comprises a cooperating set of rotary cutter disks.

9. A web replenishing apparatus as set forth in claim 1, wherein said means for bringing said head end and said tail end into edge alignment comprises sensors for sensing the location of said decurling means.

10. A web replenishing apparatus as set forth in claim 1, wherein said means for bringing said head end and tail end into close proximity with each other comprises a tucker bar for tucking said tail end into contact with said head end.

11. A device for detecting, decurling, positioning, and securely holding the edge of a stationary web, comprising:

(a) a first jaw for extending along one side of said web edge;

(b) a second jaw for extending parallel to said first jaw, along the opposite side of said fabric edge;

(c) a sensor disposed on said first jaw adjacent one end thereof for sensing the position of said web;

(d) a window disposed in said second jaw adjacent one end thereof and opposite said sensor for cooperating with said sensor in sensing the position of said web edge;

(e) a plurality of air ports disposed in one of said jaws and directed at an acute angle to the face of the other jaw, towards one end of said jaw for impinging upon a web located between said jaws for removing any curl, pleats, folds, wrinkles or the like from said web; and (f) holding means actuated for holding said web securely after said curl, pleats, folds, wrinkles or the like has been removed therefrom by air emitted from said ports and the edge of the web is sensed in a predetermined position by said sensor.

12. A device as set forth in claim 11, wherein said holding means comprises a plurality of aligned openings in the opposed faces of said jaws adjacent to the surface of said web and a plurality of pins disposed within the openings in one of said jaws and adapted to penetrate said web and to enter the openings in the other jaw to securely hold said web.

13. A device as set forth in claim 11, wherein a plurality of air ports are located in the surface of each of said opposed faces of said jaws.

14. An apparatus for detecting, decurling, positioning, and securing the edge of a stationary web, comprising:

(a) a first jaw for extending along one side of said web edge;

(b) a second jaw for extending parallel to said first jaw, along the opposite side of said web edge;

(c) a sensor disposed on said first jaw adjacent one end thereof for sensing the position of said web edge;

(d) a window disposed in said second jaw adjacent one end thereof and opposite said sensor for cooperating with said sensor in sensing the position of said web edge;

(e) means actuated for exerting a force on the surface of said web in the direction of one end of said jaws for removing any curl, pleats, folds or the like from said web;

(f) holding means for securely holding the edge of said web when said edge is detected in a predetermined position by said sensor; and (g) means for moving said jaws along each side of said web while said decurling force is exerted on the surface of said web and for actuating said web holding means when said edge of said web is sensed in a predetermined position between said jaws by said sensor to securely hold said web.

15. A device as set forth in claim 14, wherein said holding means comprises a plurality of aligned openings in the opposed faces of said jaws adjacent to the surface of said web and a plurality of pins disposed within the openings in one of said jaws and adapted to penetrate said web and to enter the openings in the other jaw to securely hold said web.

16. A device as set forth in claim 14, wherein a plurality of air ports are located in the surface of each of said opposed faces of said jaws.

17. A method of replenishing an exhausted web supply with a fresh web supply for a web processing machine, comprising the following steps:

(a) supplying a web to said web processing machine;

(b) detecting the exhaustion of said web supply and stopping said web processing machine with the tail end of said web supply in a predetermined location;

(c) detecting the tail end of the exhausted web, locating each of the longitudinal edges of said tail end, removing any pleats, curls, folds, wrinkles or the like from said tail end by exerting lateral force on said web and firmly holding each of said edges after said pleats, curls, folds, wrinkles or the like are removed from said edges and said edge is located in a predetermined position;

(d) detecting the head end of a replacement web, locating each of the longitudinal edges of said head end, removing any pleats, curls, folds, wrinkles or the like from said head end by exerting lateral force on said web, and firmly holding each of said edges after said pleats, curls, folds, wrinkles or the like are removed from said edges and said edge is located in a predetermined position;

(e) bringing said head end and said tail end into edge alignment and into close proximity with each other at a predetermined location;

(f) sewing said aligned and pretrimmed head and tail ends together;

(g) releasing said edges of said head and tail end of said sewn webs; and (h) restarting said web processing machine.

18. A method as set forth in claim 17, wherein said head and tail ends are pretrimmed adjacent the seam connecting them before they are sewn.

19. A method of detecting, decurling, positioning, and securely holding the edge of a stationary web comprising the following steps:

(a) moving a first jaw into a position where it extends along one side of said web edge;

(b) moving a second jaw into a position where it extends parallel to said first jaw along the opposite side of said web edge;

(c) sensing the position of said web between said first and second jaws;

(d) exerting a force on said web towards its edge at an acute angle to the surface of said web for removing any curls, pleats, folds, wrinkles or the like from said web; and (e) holding said web securely after said curl, pleats, folds, wrinkles or the like have been removed therefrom and only after the edge of said web is sensed in a predetermined position.

20. A method for detecting, decurling, positioning, and securing the edge of a stationary web comprising the steps of:

(a) moving a first jaw into a position extending along one side of said web edge;

(b) moving a second jaw into a position where it extends parallel to said first jaw along the opposite side of said web edge;

(c) sensing the position of the web edge between said first and second jaws;

(d) exerting a force on the surface of said web in the direction of one end of the jaws for removing any curls, pleats, folds or the like from said web;

(e) moving said first and second jaws transversely of said web towards the edge thereof until said edge is located in a predetermined position between said first and second jaws; and (f) securely holding said web between said first and second jaws immediately after said web is sensed in its predetermined position.

* * * * *